US006412620B1

(12) United States Patent
Imura

(10) Patent No.: US 6,412,620 B1
(45) Date of Patent: Jul. 2, 2002

(54) COIN DISCRIMINATING APPARATUS

(75) Inventor: Shinichi Imura, Saitama (JP)

(73) Assignee: Laurel Bank Machines Co., Ltd., Tokyo (JP)

( * ) Notice: Subject to any disclaimer, the term of this patent is extended or adjusted under 35 U.S.C. 154(b) by 0 days.

(21) Appl. No.: 09/563,316

(22) Filed: May 2, 2000

(30) Foreign Application Priority Data

May 19, 1999 (JP) ..... 11-139233

(51) Int. Cl.[7] ..... G07D 5/08
(52) U.S. Cl. ..... 194/317; 194/328
(58) Field of Search ..... 194/317, 328, 194/330, 334

(56) References Cited

U.S. PATENT DOCUMENTS

| | | | | |
|---|---|---|---|---|
| 4,108,296 A | | 8/1978 | Hayashi et al. | 194/99 |
| 5,076,414 A | | 12/1991 | Kimoto | 194/317 |
| 5,346,049 A | | 9/1994 | Nakajima et al. | 194/328 |
| 5,494,147 A | * | 2/1996 | Takahashi | 194/328 |
| 5,538,123 A | | 7/1996 | Tsuji | 194/303 |
| 5,839,563 A | * | 11/1998 | Takahashi | 194/328 |

FOREIGN PATENT DOCUMENTS

| | | | |
|---|---|---|---|
| EP | 0416932 A1 | 3/1991 | G07D/5/10 |
| EP | 0683473 A2 | 11/1995 | G07F/3/02 |
| JP | 8-36661 | 6/1996 | G07D/5/02 |

* cited by examiner

*Primary Examiner*—Donald P. Walsh
*Assistant Examiner*—Mark J. Beauchaine
(74) *Attorney, Agent, or Firm*—Frishauf, Holtz, Goodman, Langer & Chick, P.C.

(57) ABSTRACT

A coin discriminating apparatus includes light emitting elements for emitting light toward one surface of a coin being transported, a line sensor for photoelectrically detecting light reflected by the one surface of the coin and producing image pattern data of the one surface of the coin, a reference data memory for storing reference data of coins of each denomination, a preliminary denomination discriminator for calculating a diameter of the coin based on the image pattern data of the one surface of the coin produced by the line sensor, comparing the thus calculated diameter of the coin with reference diameter data of coins of each denomination and preliminarily determining the denomination of the coin, and a denomination discriminator for reading reference pattern data of coins of the denomination determined by the preliminary denomination discriminator from the reference data memory, comparing the thus read reference pattern data with image pattern data of the one surface of the coin and finally determining the denomination of the coin, at least 70% of the light emitting elements being disposed on straight lines connecting the center of a reference coin and points where a periphery of the reference coin crosses the line sensor and at positions equidistant from the center of the reference coin by the same distance L. According to the present invention, it is possible to provide a compact coin discriminating apparatus which can discriminate coins with high accuracy and can be manufactured at low cost.

12 Claims, 5 Drawing Sheets

COIN DISCRIMINATING APPARATUS

BACKGROUND OF THE INVENTION

The present invention relates to a coin discriminating apparatus and, particularly, such an apparatus for detecting the surface pattern of a coin and discriminating whether or not the coin is acceptable and the denomination of the coin.

DESCRIPTION OF THE PRIOR ART

Conventionally, it is discriminated whether or not coins are acceptable, namely, whether coins are genuine or counterfeit and whether or not coins are current coins by detecting the diameters, materials, thickness and the like of coins. However, a coin discriminating apparatus for discriminating coins by optically detecting coin surface patterns has been recently proposed in order to improve discriminating accuracy.

For example, Japanese Patent Application Laid-Open No. 8-36661 proposes a coin discriminating apparatus which optically detects the surface pattern of a coin using a CCD area sensor and compares the detected pattern with reference patterns, thereby discriminating the denomination of the coin and whether or not the coin is acceptable.

However, in the case where the surface pattern of a coin is detected using a CCD area sensor and the coin is discriminated, the coin discriminating apparatus inevitably becomes large and costly.

It is also conceivable to constitute a coin discriminating apparatus by disposing light emitting elements in an annular manner on the side of a line sensor, detecting light reflected by a coin by the line sensor, detecting the diameter of the coin as well as the surface pattern of the coin, tentatively determining the denomination of the coin based on the diameter of the coin, reading the reference surface pattern of coins of the tentatively determined denomination stored in a memory, comparing the reference surface pattern with the surface pattern of the coin detected by the line sensor, and discriminating the coin.

However, in the thus constituted coin discriminating apparatus, since the positional relationships between the respective edge portions of coins and the respective light emitting elements are not constant, it is difficult to produce the surface pattern data of the coin with high accuracy. Therefore, it is difficult to tentatively determine the denomination of the coin based on the diameter of the coin with high accuracy to reliably select the reference surface pattern data to be compared with the surface pattern data of the coin and, accordingly, it is impossible to discriminate based on the surface pattern data of the coin whether or not the coin is acceptable and the denomination of the coin with high accuracy.

SUMMARY OF THE INVENTION

It is therefore an object of the present invention to provide a compact coin discriminating apparatus which can discriminate coins with high accuracy and can be manufactured at low cost.

The above and other objects of the present invention can be accomplished by a coin discriminating apparatus comprising light emitting means for emitting light toward one surface of a coin being transported, a line sensor for photoelectrically detecting light emitted from the light emitting means and reflected by the one surface of the coin and producing image pattern data of the one surface of the coin, reference data storing means for storing reference data of coins of each denomination, first denomination determining means for calculating a diameter of the coin based on the image pattern data of the one surface of the coin produced by the line sensor, comparing the thus calculated diameter of the coin with reference diameter data of coins of each denomination stored in the reference data storing means and preliminarily determining the denomination of the coin, and denomination discriminating means for reading reference pattern data of coins of the denomination determined by the first denomination determining means from the reference data storing means, comparing the thus read reference pattern data with image pattern data of the one surface of the coin and finally determining the denomination of the coin, the light emitting means including a plurality of light emitting elements and at least 70% of the light emitting elements being disposed on straight lines connecting the center of a reference coin and points where a periphery of the reference coin crosses the line sensor and at positions equidistant from the center of the reference coin by the same distance L.

According to the present invention, at least 70% of the light emitting elements are disposed on straight lines connecting the center of a reference coin and points where a periphery of the reference coin crosses the line sensor and at positions equidistant from the center of the reference coin. The peripheral points of the coin can therefore be illuminated with light emitted from the light emitting elements under substantially the same conditions. Therefore, since a clear image can be produced by the line sensor, it is possible to discriminate the denomination of the coin with high accuracy based on the diameter of the coin and also discriminate the denomination of the coin with high accuracy by pattern-matching the image pattern data of the coin and the reference pattern data.

In a preferred aspect of the present invention, the diameter of the reference coin is set to be equal to an average diameter of coins to be handled.

In another preferred aspect of the present invention, the diameter of the reference coin is set to be an intermediate of the diameters of coins to be handled.

In a further preferred aspect of the present invention, at least 80% of the light emitting elements are disposed on straight lines connecting the center of a reference coin and points where the periphery of the reference coin crosses the line sensor and at positions equidistant from the center of the reference coin.

According to the this further preferred aspect of the present invention, the respective peripheral points of the coin can be illuminated with light emitted from the light emitting elements under still more uniform conditions. Since a clear image can therefore be produced by the line sensor, it is possible to discriminate the denomination of the coin with high accuracy based on the diameter of the coin and also discriminate the denomination of the coin with high accuracy by pattern-matching the image pattern data of the coin and the reference pattern data.

In a further preferred aspect of the present invention, the coin discriminating apparatus further includes magnetic sensor means for detecting magnetic properties of the coin and second denomination determining means for determining the denomination of the coin based on the magnetic properties of the coin detected by the magnetic sensor means, the denomination discriminating means being constituted so as to discriminate that the coin is an unacceptable coin when the denomination of the coin determined by the first denomination determining means and the denomination of the coin determined by the second denomination determining means do not coincide.

According to this further preferred aspect of the present invention, since the denomination of the coin is discriminated considering the magnetic properties of the coin, the discrimination accuracy can be further improved.

The above and other objects and features of the present invention will become apparent from the following description made with reference to the accompanying drawings.

DESCRIPTION OF THE PREFERRED EMBODIMENT

Figure 1:
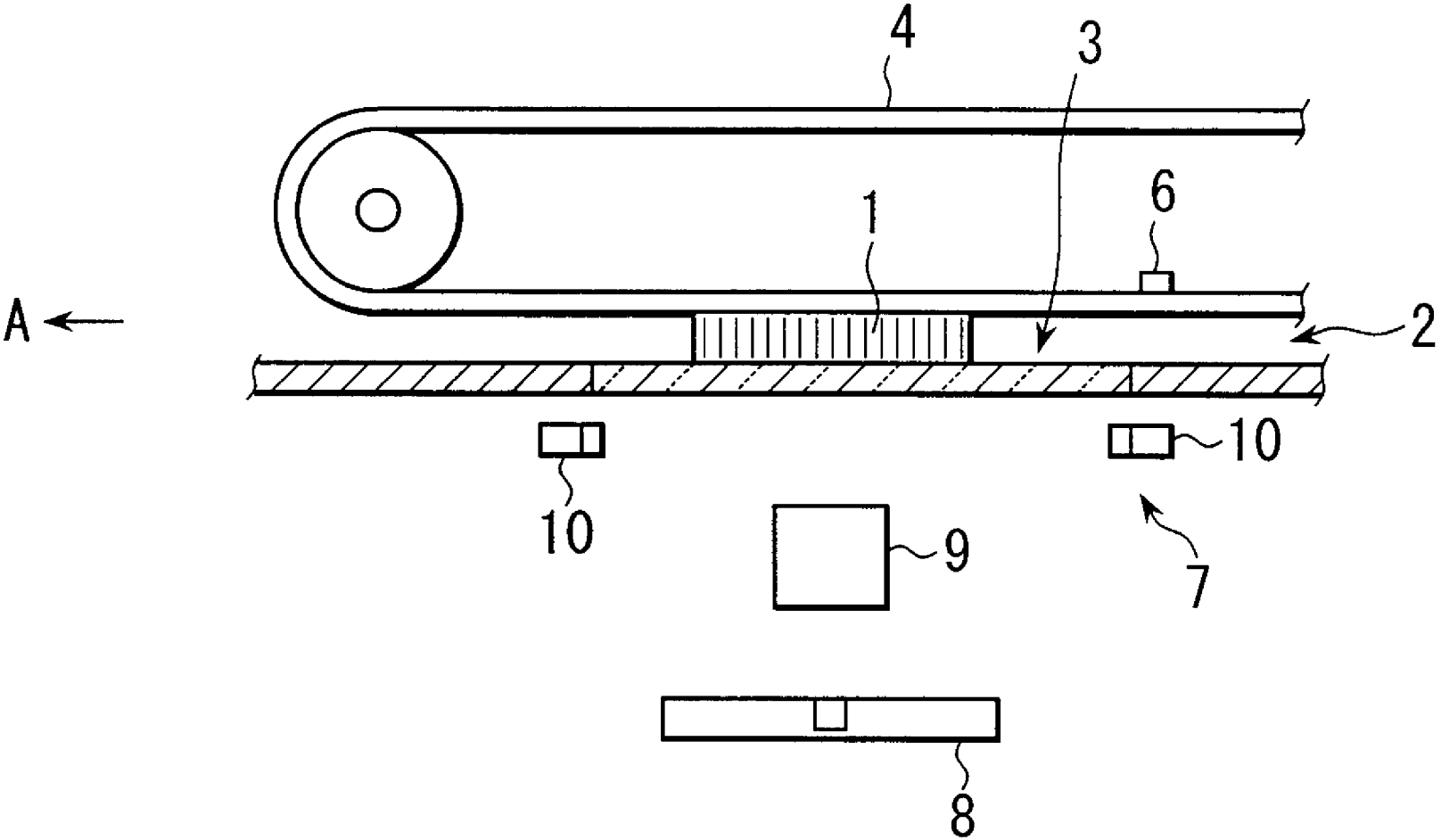
FIG. 1 is a schematic front view showing a coin discriminating apparatus which is a preferred embodiment of the present invention.

As shown in FIG. 1, a coin passage 2 through which coins 1 are transported is formed with a transparent passage portion 3 made of a transparent material such as glass, acrylic resin or the like.

A coin 1 is fed in the coin passage 2 along a pair of guide rails (not shown) in the direction indicated by an arrow A. A pair of magnetic sensors 6,6 are provided for detecting magnetic properties of the coin 1 upstream of the transparent passage portion 3 with respect to the transportation direction of the coin 1. At the transparent portion 3, the coin 1 is pressed onto the upper surface of the transparent passage portion 3 by a transporting belt 4. Below the transparent passage portion 3, light emitting means 7 is provided for emitting light toward the coin 1 passing through the transparent passage portion 3. Below the light emitting means 7, a line sensor 8 is provided for receiving light emitted from the light emitting means 7 and reflected by the coin 1 and producing surface pattern data of the coin 1 and a SELFOC lens 9 is provided for converging light emitted from the light emitting means 7 and reflected by the coin 1.

Figure 2:
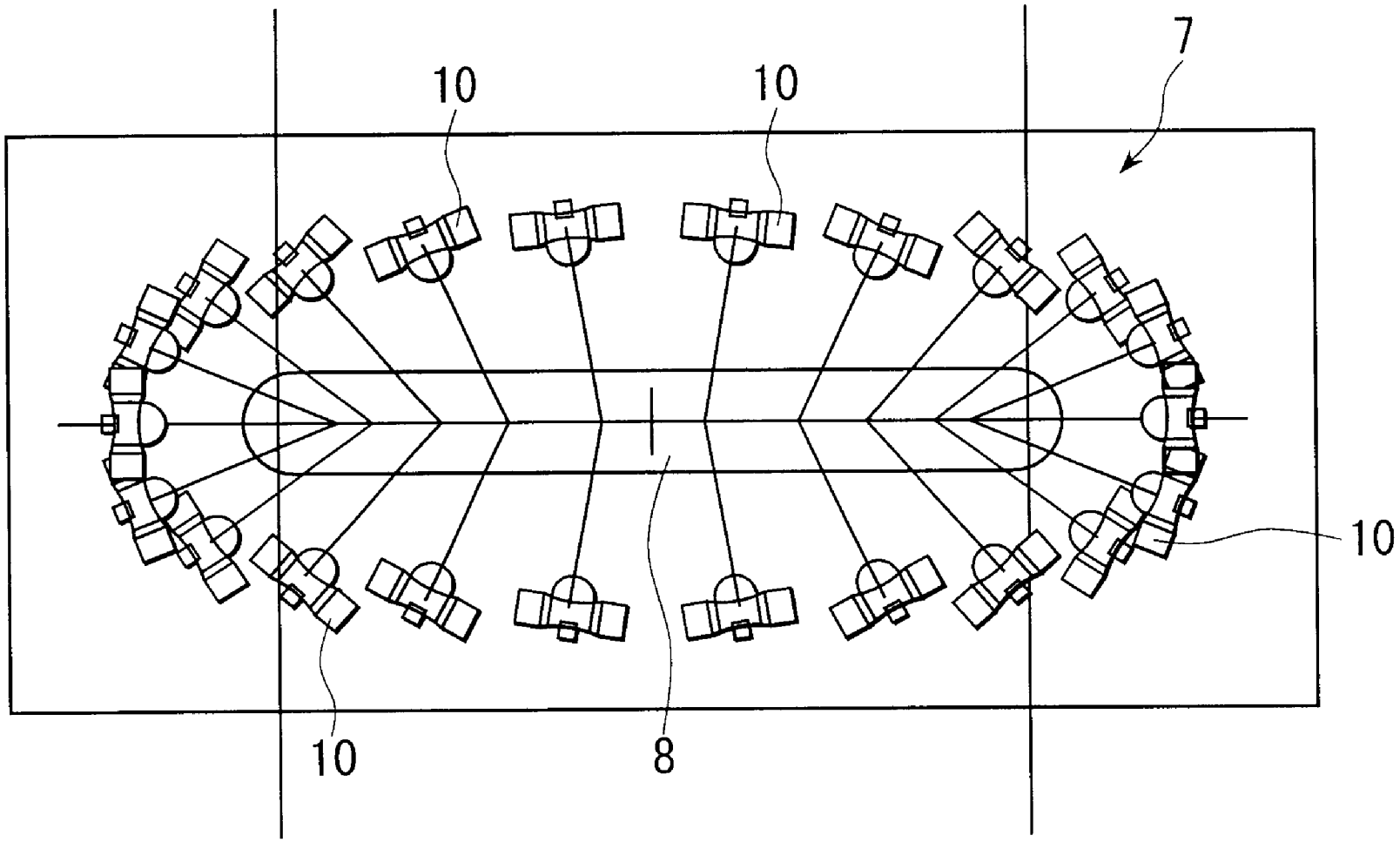
FIG. 2 is a schematic plan view showing the arrangement of light emitting elements.

FIG. 2 is a schematic plan view showing the arrangement of the light emitting means 7.

As shown in FIG. 2, the light emitting means 7 includes a number of light emitting elements 10 such as light emitting diodes (LEDs) disposed in a substantially ellipse-like manner. Each light emitting element 10 is disposed in such a manner that the optical axis thereof is directed at a small angle with respect to the horizontal direction toward a predetermined point on the center axis of the ellipse whose center coincides with the center portion of the transparent passage portion 3, whereby light is projected onto the coin 1 passing through the transparent passage portion 3 at a shallow angle with respect to the surface of the coin 1.

Each light emitting element 10 is further disposed to be positioned on a straight line connecting the center of the coin 1 and a point where the periphery of the coin 1 crosses the line sensor 8 and all light emitting elements 10 have the same positional relationship with the center of the coin 1.

FIGS. 3A to 3D show a method for disposing the light emitting elements 10.

Figure 3A:
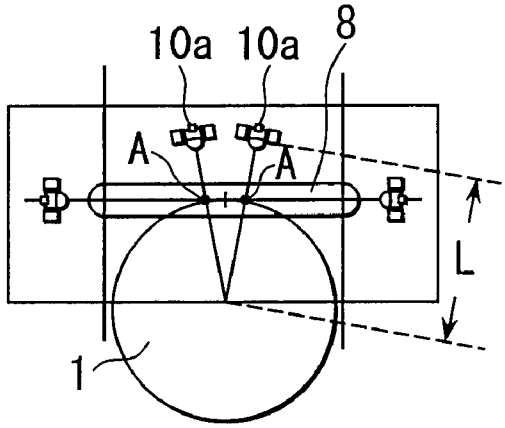
FIGS. 3A to 3D are schematic views which, when taken together, show a method for disposing light emitting elements.
Figure 3B:
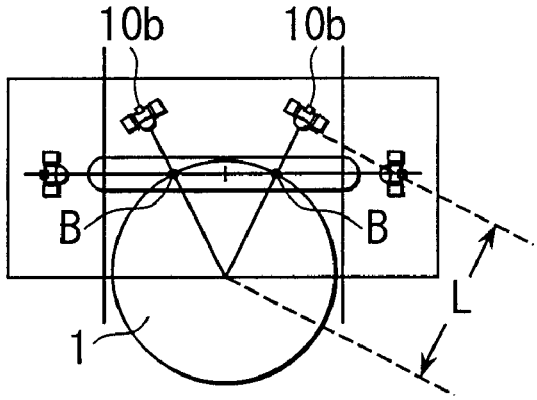
Figure 3C:
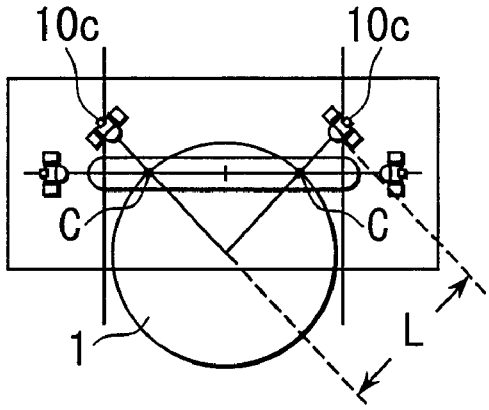
Figure 3D:
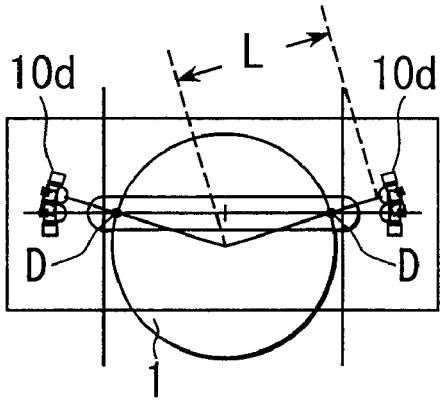

As shown in FIG. 3A, a pair of light emitting elements 10*a*, 10*a* are positioned on extensions of straight lines connecting the center of the coin 1 and points A, A of intersection between the line sensor 8 and the periphery of the coin 1 that lies laterally symmetrical with respect to a line passing through the center of the coin 1 and lying parallel with the transportation direction of the coin 1 (hereinafter referred to as the "center line"), and the light emitting elements 10*a*, 10*a* are located at the same distance L from the center of the coin 1. As shown in FIG. 3B, a pair of light emitting elements 10*b*, 10*b* are positioned on extensions of straight lines connecting the center of the coin 1 and points B, B of intersection between the line sensor 8 and the periphery of the coin 1 that lies laterally symmetrical with respect to the center line, and the light emitting elements 10*b*, 10*b* are located at the same distance L from the center of the coin 1. As shown in FIG. 3C, a pair of light emitting elements 10*c*, 10*c* are positioned on extensions of straight lines connecting the center of the coin 1 and points C, C of intersection between the line sensor 8 and the periphery of the coin 1 that lies laterally symmetrical with respect to the center line, and the light emitting elements 10*c*, 10*c* are located at the same distance L from the center of the coin 1. As shown in FIG. 3D, a pair of light emitting elements 10*d*, 10*d* are positioned on extensions of straight lines connecting the center of the coin 1 and points D, D of intersection between the line sensor 8 and the periphery of the coin 1 that lies laterally symmetrical with respect to the center line, and the light emitting elements 10*d*, 10*d* are located at the same distance L from the center of the coin 1. All of the light emitting elements 10 shown in FIG. 2 are disposed at positions determined in the same manner and, as a result, the light emitting elements 10 are disposed substantially elliptically so that the center axis of the ellipse coincides with the center of the line sensor 8.

Since every light emitting element 10 is positioned on a straight line connecting the center of the coin 1 and a point where the periphery of the coin 1 crosses the line sensor 8 and is located at the same distance from the center of the coin 1 as the other light emitting elements 10, it is possible to project light onto every peripheral point of the coin 1 from the light emitting elements under the same condition and, therefore, to produce a clear image of the coin 1 by the line sensor 8.

However, if the diameters of coins 1 vary the straight lines connecting the center of the coin 1 and peripheral points of the coin 1 when certain peripheral points of the coin 1 crosses the line sensor 8 will differ between coins 1 of different diameter. Therefore, in this embodiment, the average diameter of coins 1 to be handled is calculated to define a virtual coin having the average diameter as a reference coin and the respective light emitting elements 10 are disposed at positions spaced from the center of the reference coin by the same distance L on the straight lines connecting the center of the reference coin and the points where the periphery of the reference coin crosses the line sensor 8.

Figure 4:
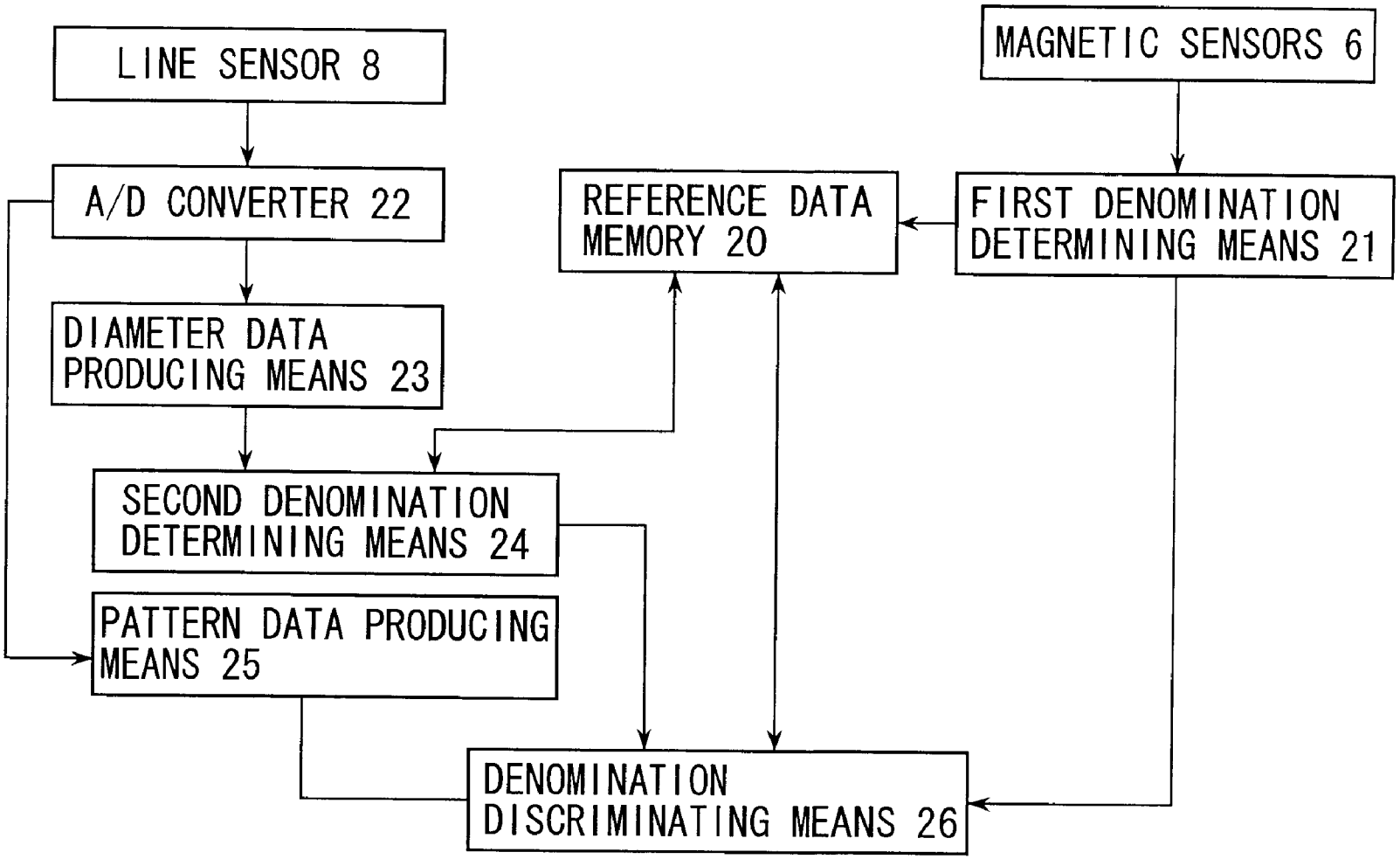
FIG. 4 is a block diagram of a detection system and a discrimination system of a coin discriminating apparatus which is a preferred embodiment of the present invention.

FIG. 4 is a block diagram of a detection system and a discrimination system of a coin discriminating apparatus which is a preferred embodiment of the present invention.

As shown in FIG. 4, the detection system of the coin discriminating apparatus includes the pair of magnetic sensors 6, 6 and the line sensor 8.

As shown in FIG. 4, the discrimination system of the coin discriminating apparatus includes a reference data memory 20 for storing reference magnetic data, reference diameter data and reference surface pattern data of coins of each denomination, first denomination determining means 21 for comparing magnetic data of a coin 1 detected by the pair of magnetic sensors 6, 6 with the reference magnetic data of coins of each denomination and determining the denomination of the coin 1, an A/D converter 22 for digitizing analog pattern data produced by the line sensor 8 photoelectrically detecting light emitted from the light emitting means 7 and reflected by the coin 1, diameter data producing means 23 for producing diameter data of a coin 1 based on pattern data of the coin 1 digitized by the A/D converter 22, second denomination determining means 24 for comparing the diameter data produced by the diameter data producing means 23 with the reference data of coins of each denomination stored in the reference data memory 20 and determining the denomination of the coin 1, pattern data producing means 25 for producing surface pattern data of a coin based on the pattern data of the coin 1 digitized by the A/D converter 22, and denomination discriminating means 26 for determining the denomination of a coin 1 based on a denomination determining signal input from the first denomination determining means 21 and a denomination determining signal input from the second denomination determining means 24, reading the reference surface pattern data of the coin 1 of the thus determined denomination from the reference data memory 20, comparing the thus read reference surface pattern data with the surface pattern data of the coin 1 input from the pattern data producing means 25 and finally discriminating the denomination of the coin 1.

The thus constituted coin discriminating apparatus according to the preferred embodiment of the present invention discriminates whether or not the coin 1 is acceptable and the denomination of the coin 1 in the following manner.

The coin 1 is fed by the transporting belt 4 along a pair of guide rails (not shown) in the direction indicated by the arrow A toward the transparent passage portion 3 in the coin passage 2 and magnetic properties thereof are detected by the pair of magnetic sensors 6, 6 disposed upstream of the transparent passage portion 3.

When the magnetic sensors 6, 6 detect the magnetic properties of the coin 1, they output detection signals to the first denomination determining means 21. The first denomination determining means 21 compares the magnetic data of the coin 1 input from the magnetic sensors 6, 6 with the reference magnetic data of coins of each denomination stored in the reference data memory 20, determines the denomination of the coin 1 and outputs a denomination determining signal to the denomination discriminating means 26.

When the coin 1 reaches the transparent passage portion 3, the coin is irradiated with light emitted from the light emitting elements 10 of the light emitting means 7. The light emitted from the light emitting elements 10 and reflected by the coin 1 is converged by the SELFOC lens 9 onto the light receiving surface of the line sensor 8.

The line sensor 8 photoelectrically detects the light emitted from the respective light emitting elements 10 and reflected by the coin 1 and produces analog pattern data of the coin 1.

In this embodiment, every light emitting element 10 is positioned on a straight line connecting the center of the reference coin and a point where the periphery of the reference coin crosses the line sensor 8 and is disposed at a position spaced from the center of the reference coin by the same distance L as the other light emitting elements 10. Therefore, it is possible to project light onto every peripheral point of the coin 1 from the light emitting elements under substantially the same conditions and, accordingly, to produce a clear image of the coin by the line sensor 8.

The analog pattern data of coin 1 produced by the line sensor 8 are input to the A/D converter 22 and digitized by the A/D converter 22 to produce surface pattern data of the coin 1. The surface pattern data of the coin 1 the A/D converter 22 produces by digitizing the analog pattern data are input to the diameter data producing means 23 and the diameter data of the coin 1 are produced by the diameter data producing means 23 and output to the second denomination determining means 24.

The second denomination determining means 24 reads the reference diameter data of coins of each denomination from the reference diameter data of coins of each denomination stored in the reference data memory 20, compares the thus read reference diameter data with the diameter data of the coin 1 produced by the diameter data producing means 23, thereby determining the denomination of the coin 1 and outputs a denomination determination signal to the denomination discriminating means 26. In this embodiment, the light emitting elements 10 are positioned on the straight lines connecting the center of the reference coin and points where the periphery of the reference coin crosses the line sensor 8 and are disposed at positions spaced from the center of the reference coin by the same distance L. The respective peripheral points of the coin 1 are therefore illuminated with light emitted from the light emitting elements under substantially the same conditions. This makes it possible to produce a clear image of the coin 1 by the line sensor 8 and, therefore, for the second denomination determining means 24 to determine the denomination of the coin 1 with high accuracy.

On the other hand, the pattern data of the surface of the coin 1 the A/D converter 22 produces by digitizing the analog pattern data are also output to the pattern data producing means 25 and the pattern data producing means 25 produces surface pattern data of the coin 1 based on the pattern data of the surface of the coin 1 input from the A/D converter 22 and outputs them to the denomination discriminating means 26.

The denomination discriminating means 26 compares the denomination discrimination signal input from the first denomination determining means 21 and the denomination discrimination signal input from the second denomination determining means 24, discriminates that the coin 1 is an unacceptable coin when the denominations determined by the first denomination determining means 21 and the second denomination determining means 24 do not coincide and outputs an unacceptable coin detection signal to a display means (not shown), thereby causing it to display that the unacceptable coin was detected.

To the contrary, when the denomination discrimination signal input from the first denomination determining means 21 and the denomination discrimination signal input from the second denomination determining means 24 coincide, the denomination discriminating means 26 discriminates that the coin 1 is an acceptable coin, reads the reference surface pattern data of coins of the denomination corresponding to that determined by the first denomination determining means 21 and the second denomination determining means 24 from the reference data memory 20, and compares the thus read reference surface pattern data with the surface pattern data of the coin 1 input from the pattern data producing means 25 by pattern-matching, thereby finally discriminating the denomination of the coin 1. In this embodiment, the light emitting elements 10 are positioned on the straight lines connecting the center of the reference coin and points where the periphery of the reference coin crosses the line sensor 8 and are disposed at positions spaced from the center of the reference coin by the same distance L. The respective peripheral points of the coin 1 can be illuminated with light emitted from the light emitting elements under substantially the same conditions. This makes it possible to produce a clear image of the coin 1 by the line sensor 8 and, therefore, to discriminate the denomination of the coin 1 with high accuracy by pattern-matching the surface pattern data of the coin 1 and the reference surface pattern data.

The pattern-matching between the surface pattern data of the coin 1 produced by the pattern data producing means 25 and the reference surface pattern data can be preferably effected using the method taught by U.S. Pat. No. 5,538,123.

Coins discriminated as acceptable and coins discriminated as unacceptable are separately collected.

According to the above described embodiment, the light emitting elements 10 are positioned on the straight lines connecting the center of the reference coin and points where the periphery of the reference coin crosses the line sensor 8 and are disposed at positions spaced from the center of the reference coin by the same distance L. The peripheral points of the coin 1 can therefore be illuminated with light emitted from the light emitting elements under substantially the same conditions. Since it is therefore possible to produce a clear image of the coin 1 by the line sensor 8, it is possible to discriminate the denomination of the coin 1 with high accuracy by pattern-matching the surface pattern data of the coin 1 and the reference surface pattern data.

Figure 5:
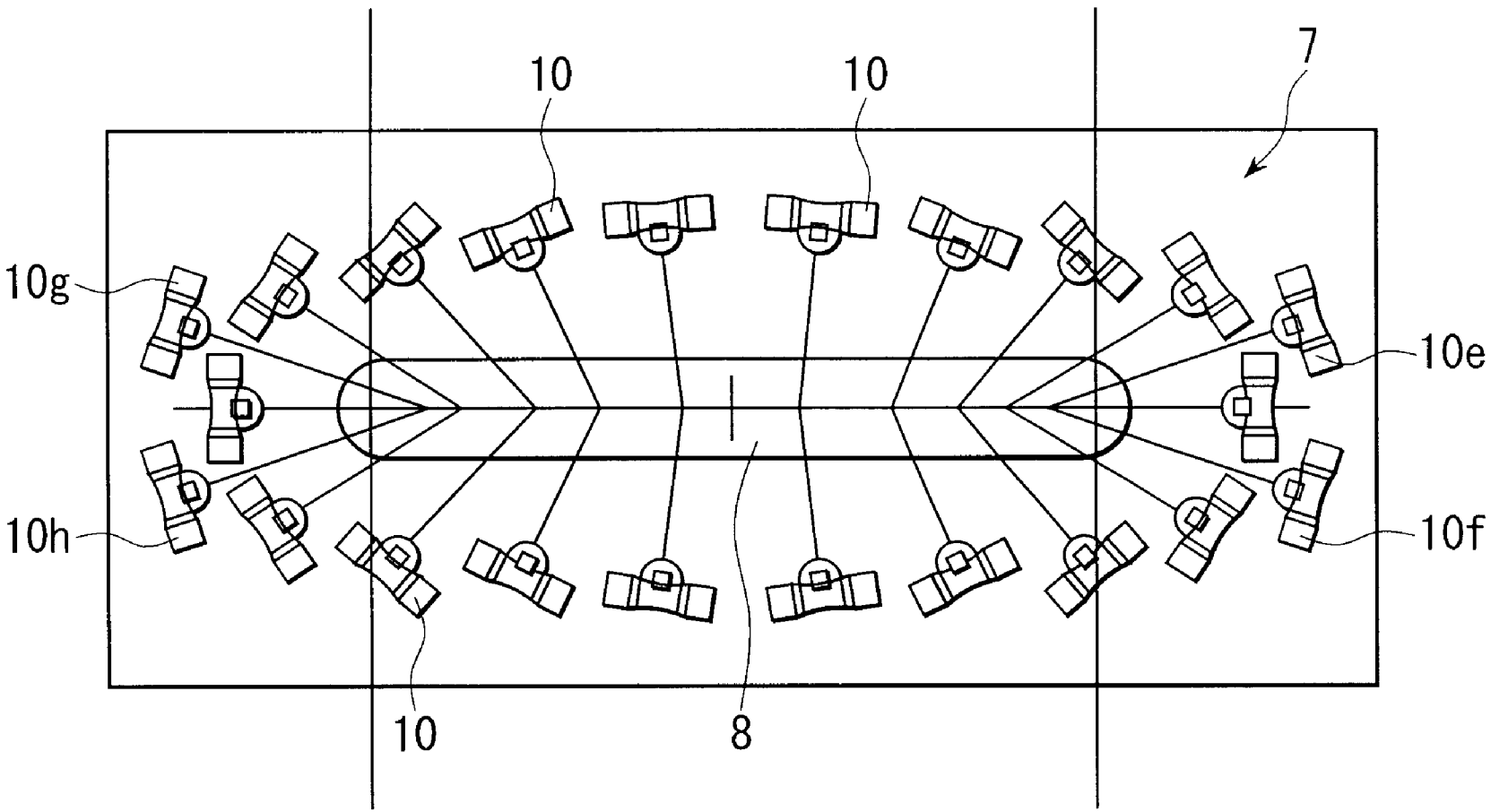
FIG. 5 is a schematic plan view showing the arrangement of light emitting elements according to another preferred embodiment of the present invention.

FIG. 5 is a schematic plan view showing the arrangement of the light emitting elements 10 according to another preferred embodiment of the present invention.

As shown in FIG. 5, in this embodiment, four light emitting elements 10*e*, 10*f*, 10*g* and 10*h* in the vicinity of the opposite end portions of the line sensor 8 are disposed on straight lines connecting the center of the virtual reference coin and peripheral points of the virtual reference coin but are located to be spaced from the center of the virtual reference coin by a distance greater than the distance L between the other light emitting elements and the center of the virtual reference coin. This arrangement is adopted because when the light emitting elements 10 are positioned on straight lines connecting the center of the virtual reference coin and points of intersection between the line sensor 8 and the periphery of the reference coin are disposed at positions spaced from the center of the reference coin by the same distance L, many light emitting elements come to be present in the vicinity of the opposite end portions of the line sensor 8. In this embodiment, the four light emitting elements 10*e*, 10*f*, 10*g* and 10*h* are therefore disposed at positions different from their most desirable positions.

It was experimentally confirmed that a clear image of the coin 1 can be obtained if at least 70% of the light emitting elements 10 are disposed on straight lines connecting the center of the reference coin and points of intersection between the line sensor 8 and the periphery of the reference coin and at positions spaced from the center of the reference coin by the same distance L. Moreover, it was found to be more preferable when at least 80% of the light emitting elements 10 are disposed on straight lines connecting the center of the reference coin and points of intersection between the line sensor 8 and the periphery of the reference coin and at positions spaced from the center of the reference coin by the same distance L.

The present invention has thus been shown and described with reference to specific embodiments. However, it should be noted that the present invention is in no way limited to the details of the described arrangements but changes and modifications may be made without departing from the scope of the appended claims.

For example, in the above described embodiments, the first denomination determining means 21 determines the denomination of the coin 1 based on the magnetic data of the coin 1 detected by the pair of magnetic sensors 6, 6 disposed upstream of the transparent passage portion 3 and when the denomination thus determined by the first denomination determining means 21 does not coincide with the denomination determined by the second denomination determining means 24 based on the diameter of the coin 1, it is discriminated that the coin 1 is unacceptable. However, it is possible to provide the magnetic sensors 6, 6 downstream of the transparent passage portion 3, first determine the denomination of the coin 1 based on the diameter and surface pattern thereof, then determine the denomination of the coin 1 based on magnetic properties of the coin 1 detected by the magnetic sensors 6, 6 and discriminate that the coin 1 is unacceptable when the results of discrimination made by the first denomination determining means 21 and the second denomination determining means 24 do not coincide with each other.

Further, in the above described embodiments, although the light emitting elements 10 are disposed using the virtual coin having an average diameter of the coins 1 to be handled as the reference coin, the light emitting elements 10 may be disposed using a coin having a standard diameter among the diameters of coins to be handled as a reference coin and, therefore, the light emitting elements 10 can be disposed using a coin having an intermediate diameter among coins to be handled instead of the virtual coin having an average diameter of the coins 1 to be handled.

Furthermore, in this specification and the appended claims, the respective means need not necessarily be physical means and arrangements whereby the functions of the respective means are accomplished by software fall within the scope of the present invention. In addition, the function of a single means may be accomplished by two or more physical means and the functions of two or more means may be accomplished by a single physical means.

According to the present invention, it is possible to provide a compact coin discriminating apparatus which can discriminate coins with high accuracy and can be manufactured at low cost.

What is claimed is:

1. A coin discriminating apparatus comprising:

light emitting means for emitting light toward one surface of a coin being transported, a line sensor for photoelectrically detecting light emitted from the light emitting means and reflected by the one surface of the coin and producing image pattern data of the one surface of the coin, reference data storing means for storing reference data of coins of each denomination, first denomination determining means for calculating a diameter of the coin based on the image pattern data of the one surface of the coin produced by the line sensor, comparing the thus calculated diameter of the coin with reference diameter data of coins of each denomination stored in the reference data storing means and preliminarily determining the denomination of the coin, and denomination discriminating means for reading reference pattern data of coins of the denomination determined by the first denomination determining means from the reference data storing means, comparing the thus read reference pattern data with image pattern data of the one surface of the coin and finally determining the denomination of the coin, the light emitting means comprising a plurality of light emitting elements and at least 70% of the light emitting elements being disposed on straight lines connecting the center of a reference coin and points where a periphery of the reference coin crosses the line sensor and at positions equidistant from the center of the reference coin by the same distance L.

2. A coin discriminating apparatus in accordance with claim 1 wherein the diameter of the reference coin is set to be equal to an average diameter of coins to be handled.

3. A coin discriminating apparatus in accordance with claim 2 wherein at least 80% of the light emitting elements are disposed on straight lines connecting the center of a reference coin and points where the periphery of the reference coin crosses the line sensor and at positions equidistant from the center of the reference coin.

4. A coin discriminating apparatus in accordance with claim 3 which further comprises magnetic sensor means for detecting magnetic properties of the coin and second denomination determining means for determining the denomination of the coin based on the magnetic properties of the coin detected by the magnetic sensor means, the denomination discriminating means being constituted so as to discriminate that the coin is an unacceptable coin when the denomination of the coin determined by the first denomination determining means and the denomination of the coin determined by the second denomination determining means do not coincide.

5. A coin discriminating apparatus in accordance with claim 2 which further comprises magnetic sensor means for detecting magnetic properties of the coin and second denomination determining means for determining the denomination of the coin based on the magnetic properties of the coin detected by the magnetic sensor means, the denomination discriminating means being constituted so as to discriminate that the coin is an unacceptable coin when the denomination of the coin determined by the first denomination determining means and the denomination of the coin determined by the second denomination determining means do not coincide.

6. A coin discriminating apparatus in accordance with claim 1 wherein the diameter of the reference coin is an intermediate of the diameters of coins to be handled.

7. A coin discriminating apparatus in accordance with claim 6 wherein at least 80% of the light emitting elements are disposed on straight lines connecting the center of a reference coin and points where the periphery of the reference coin crosses the line sensor and at positions equidistant from the center of the reference coin.

8. A coin discriminating apparatus in accordance with claim 7 which further comprises magnetic sensor means for detecting magnetic properties of the coin and second denomination determining means for determining the denomination of the coin based on the magnetic properties of the coin detected by the magnetic sensor means, the denomination discriminating means being constituted so as to discriminate that the coin is an unacceptable coin when the denomination of the coin determined by the first denomination determining means and the denomination of the coin determined by the second denomination determining means do not coincide.

9. A coin discriminating apparatus in accordance with claim 6 which further comprises magnetic sensor means for detecting magnetic properties of the coin and second denomination determining means for determining the denomination of the coin based on the magnetic properties of the coin detected by the magnetic sensor means, the denomination discriminating means being constituted so as to discriminate that the coin is an unacceptable coin when the denomination of the coin determined by the first denomination determining means and the denomination of the coin determined by the second denomination determining means do not coincide.

10. A coin discriminating apparatus in accordance with claim 1 wherein at least 80% of the light emitting elements are disposed on straight lines connecting the center of a reference coin and points where the periphery of the reference coin crosses the line sensor and at positions equidistant from the center of the reference coin.

11. A coin discriminating apparatus in accordance with claim 10 which further comprises magnetic sensor means for detecting magnetic properties of the coin and second denomination determining means for determining the denomination of the coin based on the magnetic properties of the coin detected by the magnetic sensor means, the denomination discriminating means being constituted so as to discriminate that the coin is an unacceptable coin when the denomination of the coin determined by the first denomination determining means and the denomination of the coin determined by the second denomination determining means do not coincide.

12. A coin discriminating apparatus in accordance with claim 1 which further comprises magnetic sensor means for detecting magnetic properties of the coin and second denomination determining means for determining the denomination of the coin based on the magnetic properties of the coin detected by the magnetic sensor means, the denomination discriminating means being constituted so as to discriminate that the coin is an unacceptable coin when the denomination of the coin determined by the first denomination determining means and the denomination of the coin determined by the second denomination determining means do not coincide.

* * * * *